US005502947A

United States Patent [19]

Birkenfeld et al.

[11] Patent Number: 5,502,947

[45] Date of Patent: Apr. 2, 1996

[54] METHOD OF AND APPARATUS FOR SHRINKING A SHRINK FILM COVER

[75] Inventors: Richard Birkenfeld; Peter Aka, both of Beckum, Germany

[73] Assignee: Maschinenfabrik Möllers GmbH u. Co., Beckum, Germany

[21] Appl. No.: 329,573

[22] Filed: Oct. 26, 1994

[30] Foreign Application Priority Data

Oct. 26, 1993 [DE] Germany ..... 43 36 387.3
Jul. 5, 1994 [DE] Germany ..... 44 23 513.5

[51] Int. Cl.[6] ..... B65B 53/06

[52] U.S. Cl. ..... 53/442; 53/459

[58] Field of Search ..... 53/557, 442, 459, 53/567

[56] References Cited

U.S. PATENT DOCUMENTS

| | | | |
|---|---|---|---|
| 3,777,446 | 12/1973 | Graver | 53/557 |
| 4,562,689 | 1/1986 | Hannen | 53/442 |
| 4,575,989 | 3/1986 | Hannen | 53/442 |
| 4,616,471 | 10/1986 | Hannen | 53/442 |

FOREIGN PATENT DOCUMENTS

| | | | |
|---|---|---|---|
| 403906 | 5/1986 | European Pat. Off. | 53/442 |
| 249534 | 12/1987 | European Pat. Off. | 53/442 |
| 116124 | 12/1992 | European Pat. Off. | 53/442 |
| 3142100 | 4/1983 | Germany | 53/442 |

*Primary Examiner*—John Sipos
*Assistant Examiner*—John Paradiso
*Attorney, Agent, or Firm*—Anderson Kill Olick & Oshinsky

[57] ABSTRACT

A method of and apparatus for shrinking a shrink film cover covering a stack of goods and having a free edge thereof located beneath the stack bottom, which method and apparatus includes providing a shrink frame, movable vertically along the stack, for applying hot air to the shrink film cover to provide from below upwards thermal energy necessary for shrinkage of the shrink film cover, providing an arrangement for inflating the shrink film cover with hot air to form a space closed by the shrink film cover, with overpressure being maintained in the closed space until application of the thermal energy ends, and delivering hot air from the shrink frame to a lower region of the shrink film cover into a collecting compartment located beneath a stack bottom and, thereafter, from the collecting compartment into the space closed by the shrink film cover.

3 Claims, 1 Drawing Sheet

METHOD OF AND APPARATUS FOR SHRINKING A SHRINK FILM COVER

Methods and apparatuses for shrinking a shrink film cover over a stack of goods are generally known. One such method and apparatus is described in European Patent 0 116 124 B2. In this European patent, instead of a shrink frame, a hot gas pole is used.

An important feature of the known method consists in that the overpressure in the space, which is closed by the shrink film cover, is maintained with fresh air until the shrink film cover is inflated, with the overpressure being less than the expected shrink tension, and with applying thermal energy to the shrink film cover while maintaining the reduced overpressure. The purpose of inflating the shrink film covers before shrinking, especially the shrink film covers formed of a polyethylen, is to be able to shrink the cover over a small dimension stack wrapped therewith, without an undesirable gluing of the shrink film cover, with the packaging material of the stack.

Therefore, it is important in European patent EP 0 116 124 B2, to maintain the overpressure inside the shrink film with the fresh air, which also cools the outer walls of the stack so that they would have a temperature smaller than that of the cover. Thereby welding of the shrink film cover material to the packaging material of the stack is prevented.

However, it was established that by additionally inflating the cover with fresh air after positioning of the cover edge portion beneath the stack and before the shrinking process proper, i.e., before the application of the heat, the inflating process is not insignificantly slowed down and the packaging output in a unit of time is reduced in comparison with other known packaging processes. It was also established that, because of inflating the cover with the fresh air, the energy consumption necessary for heating and shrinking the cover is increased.

It is also known, as being desirable (please see publication, "Neue Verpackung" ("New Packaging"), 11/1968, p.p. 1646, 1648 and 1650), to cover a stack of goods with a shrink film cover and to draw the open edge ends of the cover under the stack. Thereafter, the covered stack is transported on a conveyor to a closed shrink tunnel where the cover is shrinked with hot air.

By directional flow of hot air jets in the shrink tunnel, it is achieved that heating of the cover is accompanied by a light inflation of the cover. By inflating the cover, a full-surface contact of the packaged goods with the shrink film cover, which is heated above 100° C., is prevented during the shrinking process so that the influence of the heat on the goods is kept to a minimum.

Only after the covered stack leaves the shrink tunnel, during the cooling step, the shrink cover tightly envelops the packaged goods. Thus, with the beginning of the heating of the shrink cover, a pressure difference exists between the pressure in the space closed by the shrink cover and the pressure in the space in which the hot air circulates, which pressure difference provides for shrinkage of the shrink cover by its further heating. However, the method of shrinking in a shrink tunnel is not applicable to a method in which a vertically displaceable shrink frame is used, because there is no closed space available in which there can be provided stationary hot air ducts and guide elements.

European publication EP 0 403 906 discloses an apparatus for shrinking a shrink cover covering a stack of goods, wherein the conveyor is interrupted and the shrink frame in a non-operating condition is lowered below the conveyor level, so that it is possible, in this position of the shrink frame, to transport a stack, over which a shrink cover is to be shrinked, in the shrinking apparatus.

If the hot gas nozzles of the shrink frame are already actuated, when the shrink frame is still in its lower position, a hot gas cloud can be formed unintentionally beneath the pallet.

German publication DE 31 41 100 A1 discloses a method of shrinking a shrink cover in which, in order to draw the shrink cover under the pallet, the pallet is lifted and the air is aspirated under it with a blower, whereby the film edge abuts the pallet bottom. In this position, the edge is shrunk by applying heat thereto.

An object of the invention, therefore, is to improve the known method and apparatus to such an extent that the packaging process can be accelerated while the energy consumption is reduced.

SUMMARY OF THE INVENTION

The invention relates to a method of shrinking a shrink film cover, which covers a stack of goods and has a free edge thereof located beneath the stack or pallet bottom, which method comprises the steps of providing a shrink frame, movable vertically along the stack, for applying to the shrink film cover hot air to provide from below upwards thermal energy necessary for shrinkage of the shrink film cover, and inflating the shrink film cover with hot air so that a space closed by the shrink film cover is formed, with overpressure being maintained in the closed space until application of the thermal energy is completed and with delivering the hot air from the shrink frame to a lower region of the shrink film cover and beneath a stack bottom and thereafter, into the space closed by the shrink film cover.

The invention also relates to an apparatus for effecting the method and comprising a conveyor for transporting the stack, a device for lifting the stack above a conveyor plane, a shrink frame movable vertically along the stack, a box-like collecting compartment located beneath the conveyor plane and having an open side facing a stack bottom, and blower means located inside the collecting compartment for aspirating the hot air and for delivering the hot air from the collecting compartment into a space closed by the shrink film cover.

This and other objects of the invention, which will become apparent hereinafter, are achieved by providing a process in which, after applying hot air from the shrink frame to a bottom region of the shrink cover, after forming a hot air cushion beneath the pallet, and after inflating the shrink cover, the shrink frame is displaced along the stack from below upwards with continuous application of heat energy to the shrink cover.

It has been found out unexpectedly that in open shrinking devices, other than those used by those skilled in the art up to the present and described in European patent EP 0 116 124 B2, it is not only the fresh air which is suitable to achieve the desired inflating effect without the danger of welding of the shrink film cover to the packaging material of the package. It has been found that the same results can be achieved with hot air and also without the undesirable welding of the shrink film cover to the packaging material.

The advantage of the inventive process in comparison with the conventional method consists in that the duration of the process is noticeably reduced, because inflation of the shrink cover is effected simultaneously with the heating and shrinking of the bottom region of the shrink cover edge, and further, because the shrink cover is additionally heated from within with the hot air. As a result, the shrinking process is accelerated and the shrinking effect is obtained more rapidly.

This process is especially advantageous for shrinking thin films because of substantial cost savings achieved therewith. The acceleration of the shrinking process is further increased by already displacing the shrink frame before the entire inflating step is finished. That is, the shrink frame is displaced along the stack upward while the inflating process still takes place so that, at the start of the upward movement of the shrink frame, the total amount of the hot air necessary for completion of the inflating step enters the space closed with the shrink cover.

Another advantage of the inventive process consists in that the hot air between the shrink cover and the stack provides a substantially better isolation of the stack in comparison with a column of fresh air. As a result, the emission of heat from the shrink cover in the direction of the packaged goods is substantially reduced because of a small temperature difference between the shrink cover and the hot air column between the cover and the stack. This results in reduced losses of heat energy which is supplied from the shrink frame and, therefore, a reduced amount of energy need be supplied by the shrink frame.

This isolation effect takes place naturally, not only when thin films are used, but also when thick films are used, for example, for packaging heavy machine parts, when the heat losses are significant because of a very high thermal conductivity of these parts. The isolation effect results from a high temperature of the hot air between the shrink cover and the stack. In addition, the collection or storage of the hot air before the inflation step also reduces heat consumption.

According to a particular embodiment of the invention, it is contemplated to continuously deliver hot air to the stack bottom from the collecting compartment after the spaced closed by the shrink cover has been filled with hot air. The amount of the hot air delivered after the end of the inflating step is adjusted so that the air pressure in the close space is maintained constant, without an additional inflation of the shrink cover. In this manner, it is insured that the heat air between the shrink cover and the smack remains there and does not flow downward during the entire shrinking process.

This is because an air cushion, which is formed beneath the stack by continuous delivery of hot air after the inflating process has been finished, prevents return flow of hot air located in the space between the stack and the cover. However, the amount of hot air in the air cushion is so adjusted that leakage of the air, located in the space between the stack and the shrink cover, is possible, and is adjusted to permit leakage corresponding to the reduction of the space between the shrink cover and the stack resulting from the shrinkage of the shrink cover. Such leakage prevents too large inflation of the shrink cover.

According to the invention, it is further advantageously contemplated to prevent flow of the outside air into the collecting compartment after the inflation of the shrink cover was completed. Thereby, it is insured that after the inflating step and the suction of the hot air into the collecting compartment, no cold air enters thereinto so that the hot air contained in the collecting compartment does not cool off.

According to the invention, there is also provided an apparatus for effecting the above-described method of the present invention. The inventive apparatus comprises a conveyor for transporting the stack, a device for lifting the stack above a conveyor plane, a shrink frame movable vertically along the stack, a box-like collecting compartment located beneath the conveyor plane and having an open side facing a stack bottom, and blower means located inside the collecting compartment for aspirating the hot air and for delivering the hot air from the collecting compartment into a space closed by the shrink film cover. The collecting compartment having through-openings for receiving the hot air thereinto.

The apparatus, according to the present invention, provides for obtaining of an enclosed collecting compartment into which the hot air is delivered from the shrink frame and thereafter enters from below, into the space closed by the shrink cover, without a possibility of entry of the surrounding outside air after the completion of the inflating step into the closed space.

It is advantageously contemplated to provide, inside the collecting compartment, ducts for the hot air for communicating the hot air from the through-openings to the blower. The ducts insure a directional delivery of the hot air to the blower that thereafter provides for discharge of the hot air into the space closed with the shrink cover.

It is further advantageously contemplated to thermally insulate the collecting compartment. The thermal insulation permits to maintain the temperature of the hot air aspirated into the collecting compartment substantially unchanged. This insures that the hot air, which enters the space closed with the shrink cover from the collecting compartment, still has a required temperature.

It is especially advantageous, according to the invention, that the blower has a variable output. This makes possible to control the operation of the blower so that during the inflating step, the flow rate of the hot air which enters the space closed by the shrink cover from the collecting compartment is high, while after the end of the inflating step, the flow rate of the hot air for forming an air cushion beneath the stack can be reduced. To this end, the blower is equipped with a speed-controlled drive which insures easy control of the blower output.

It is further advantageously contemplated, according to the invention, to provide the through-openings and/or ducts with shut-off elements that reliably close them. These elements permit, by an appropriate adjustment thereof, to completely close the openings and/or the ducts after the end of the inflating step, so that no outside air enters the collecting compartment after the shrink frame is not in its lowest position anymore. This permits to maintain a required temperature of the hot air in the collecting compartment.

BRIEF DESCRIPTION OF THE DRAWINGS

The objects and features of the present invention will become more apparent, and the invention itself will be best understood, from the following detailed description of the preferred embodiment when read with reference to the accompanying drawings, wherein.

DETAILED DESCRIPTION OF THE PREFERRED EMBODIMENT

Figure 1:
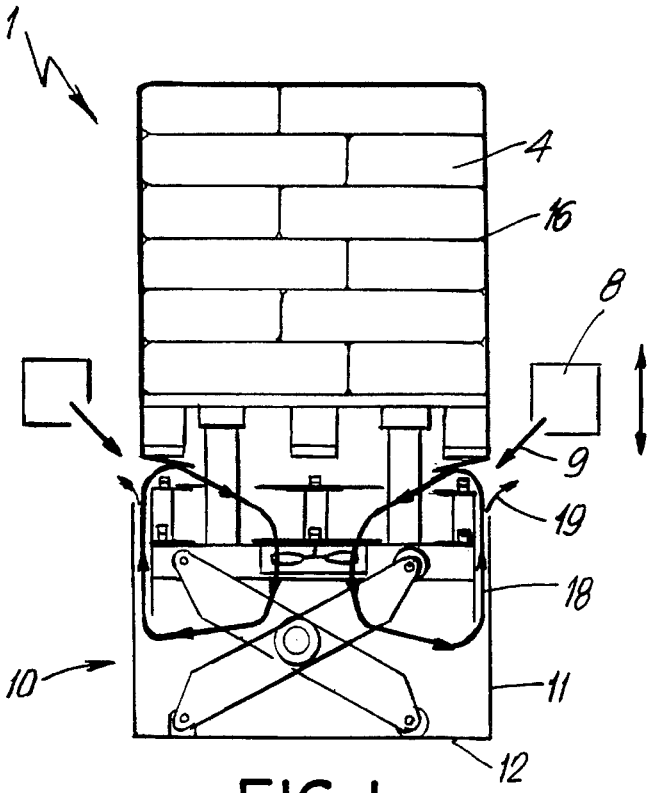
FIG. 1 is an apparatus for shrinking a shrink film cover according to the present invention before inflating the cover.

In the drawings, only those parts of an apparatus for shrinking a shrink film cover are shown which are essential for carrying out the invention.

The shrinking apparatus 1, which is shown in the Figures, includes, as known, a chain conveyor 2 having, in the disclosed embodiment, three chain transporters or chains 2*a* extending parallel to each other. The conveyor plane of the chain conveyor 2 is designated with a reference numeral 3. A stack of goods 4 is transported on the chain conveyor 2 on a pallet 5. The chains 2*a* of the chain conveyor 2 are guided over direction-reversing devices (not shown) and run in an opposite direction beneath the conveyor plane 3.

Figure 3:
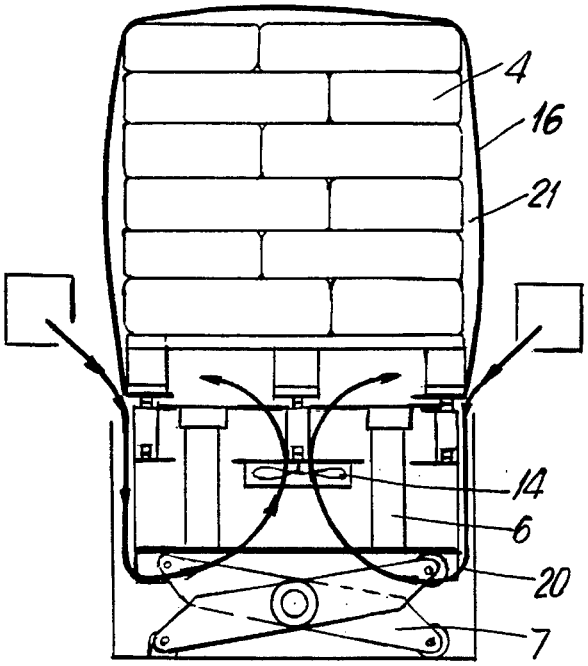
FIG. 3 is the same apparatus, which is shown in FIG. 1, but after inflating the cover.

Lifting piston 6 of a lifting device 7 are arranged between the chains 2*a* of the chain conveyor 2. The lifting pistons 6 lift the pallet 5, together with the stack of goods 4, above the conveyor plane 3 (FIG. 3) or support the pallet 5, together with the stack of goods 4, above the conveyor plane (FIG. 1).

The shrinking apparatus 1 further includes a cover pulling device, not separately shown, and a shrinking device including a closed shrink frame 8 which, in a non-shown position of the shrinking apparatus, is movable vertically up and down along the snack 4. The shrink frame 8 includes a plurality of horizontally extending slot nozzles which enable discharge of air in the direction, shown by arrows 9, at an angle downward toward the stack. Through these slot nozzles, hot air which is heated by a gas burner, by electrical means or otherwise, is discharged from the shrink frame. This, likewise, is not shown separately.

Beneath the conveyor plane 3 of the conveyor 2, there is provided a box-type collecting compartment 10 which opens toward the bottom of the stack. The box-type compartment 10 limits the space beneath the stack 4 and includes side walls 11 and a bottom 12. The box-type compartment 10 is provided with an appropriate heat insulation, not shown. The top of the compartment 10 is, as aforementioned, open and is being closed by the bottom of the stack or the bottom of the pallet 5. However, openings, which are designated with reference numeral 13, are provided in the edge region of the compartment 10.

At least one blower 14 is provided in the inner space of the compartment 10 which also surrounds the lifting device 7 and the conveyor 2. The blower 14 is formed as reversible air suction and air discharge blower preferably with a variable power control. The blower 14 is equipped with a drive motor (not shown) having a speed control.

In addition, ducts 15 connected to the openings 13 are provided in the compartment 10. The ducts 15 enable a directional flow of air from the openings 13 to the blower 14. The ducts 15 are limited by inner walls 22 provided in the compartment 10 and the side walls 11 thereof. Inside the ducts 15 there are provided flexible petal caps 23. The function of the petal caps 23 will be explained in detail below.

The shrinking apparatus according to the present invention functions as follows:

The stack of goods 4 is transported on a pallet 5 on the conveyor 2 of the shrinking apparatus 1. The stack 4 is covered with the shrink film cover 16 in the shrinking apparatus 1 or beforehand. After being covered, the stack 4 is lifted by the lifting pistons 6 of the lifting device 7 above the conveyor plane 3. The lower portion 17 of the shrink film cover 16 hangs free, after the stack has been lifted, beneath the bottom edge of the stack 4 or the pallet 5.

Figure 2:
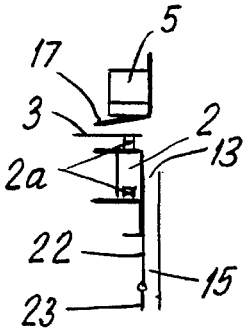
FIG. 2 is a detail of the apparatus of FIG. 1 shown at an increased scale.

This cover lower portion 17 is then pulled under the pallet 5 with the blower 14 operating in an air suction mode and with the air circulating in the compartment 10, as shown by arrow 18. During this stage of operation, the petal caps 23 remain open (as shown in FIG. 2) enabling flow of air through the ducts 15. The circulating air provides for drawing of the cover lower portion 17 under the pallet 5. Simultaneously, the shrink frame 8 is displaced into its lowest position, with the hot air acting on the cover lower portion 17 as indicated by arrow 9.

The hot air is also aspirated into the compartment 10 by the blower 14. This causes shrinkage of the cover lower portion 17 under the pallet 5. The hot air that flows into the compartment 10 forces the air, located in the compartment 10 and which is still cold, to flow out of the compartment in the direction of arrow 19.

After the shrinkage of the cover lower portion 17, the stack 4 is lowered by the lifting device 7 onto the conveyor plane 3, and the operation of the blower 14 is switched from the suction mode to the discharge mode whereby the hot air discharged from the shrink frame 8, which remains in the unchanged vertical position, flows into the compartment 10 where it circulates as shown by arrow 20. The hot air discharged from the shrink frame 8 flows through the channels 15 (with the petal caps 23 being open) into the compartment 10 and, therefrom, into the space closed by the shrink film cover 16. As a result, the shrink film cover 16 is inflated with respect to the stack 4. The inflated region is designated by a reference numeral 21.

Because the air which flows from the compartment 10 into the shrink film cover 16 is heated, a column of heated air is formed between the stack 4 and the shrink film cover 16 in the region 21.

After the inflation of the shrink film cover 16 or in the last stage of inflating the cover, the shrink frame 8 will be displaced upward in a conventional manner, with continuous discharge of hot air in the direction of arrow 9 along the stack 4, so than the shrink film cover will gradually shrink over the stack 4.

Figure 4:
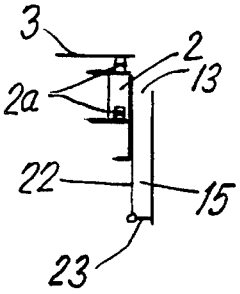
FIG. 4 is a detail of the apparatus of FIG. 3 shown at an increased scale.

After the inflation of the shrink film cover 16, the ducts 15 are closed by closing the petal caps 23 (as shown in FIG. 4) and no external air can enter the compartment 10. At the same time, the blower 14 continues to operate in the discharge mode but with a decreased power, which is achieved by reducing the drive motor speed. At that, the speed is so adjusted that with the blower 14 operating with a decreased power, the heated air is continuously applied to the bottom of the stack 4 or the pallet 5 so that, without additionally inflating the shrink film cover 16, it prevents the air which fills the inflated region 21 from flowing out therefrom. Thus, an air cushion is formed at the bottom of the stack 4.

Thereby, by controlling the blower power or output, a return flow of air from the reduced inflated space 21, as a result of shrinkage, is possible with the air discharged from the space 21, corresponding to the reduction of the space volume. On the other hand, the flow of air from the compartment 10 into the space 21 is prevented. Thus, it is assured that during the entire shrinking process, only hot air will remain in the space 21 between the shrink film cover and the stack 4.

Naturally, the invention is not limited by the disclosed embodiment and further modifications are possible. Importantly, however, that for inflating the shrink film cover, only hot air discharged from the shrink frame is used, so that a relatively small temperature gradient exists between the temperature of the air in the inflated space 21 and the hot air at the side wall of the shrink film cover during displacement of the shrink frame upward.

Accordingly, it is to be understood that the form of the invention, herein shown and described, is to be considered as a preferred embodiment only, and that various changes thereof may be made without departing from the spirit and scope of the invention as defined by the appended claims.

What is claimed is:

1. A method of shrinking a shrink film cover, which covers a stack of goods and has a free edge thereof located beneath the stack bottom, said method comprising the steps:

providing a shrink frame, movable vertically along the stack, for applying to the shrink film cover hot air to provide from below upwards thermal energy necessary for shrinkage of the shrink film cover;

inflating the shrink film cover with hot air, whereby a space closed by the shrink film cover is formed, with overpressure being maintained in the closed space until application of the thermal energy is completed, said inflating step comprising delivering hot air from the shrink frame to a lower region of the shrink film cover and beneath a stack bottom and thereafter, into the space closed by the shrink film cover; and displacing the shrink frame along the stack from below upwards, after inflating the shrink film cover to a predetermined degree, while continuously applying the thermal energy to the shrink film cover.

2. A method as set forth in claim 1, further comprising the steps of providing a collecting compartment beneath the stack bottom, which is being filled with the hot air during inflating of the shrink film cover, and continuously applying a controlled amount of the hot air from the collecting compartment to the stack bottom, with the controlled amount of the hot air being so adjusted that air pressure in the space closed with the shrink film cover is maintained substantially constant, without further inflating the shrink film cover.

3. A method as set forth in claim 2, further comprising the step of cutting off delivery of the hot air into the collecting compartment from outside after the shrink film cover has been inflated to the predetermined degree.

* * * * *